US005892388A

United States Patent [19]

Chiu

[11] Patent Number: 5,892,388

[45] Date of Patent: Apr. 6, 1999

[54] LOW POWER BIAS CIRCUIT USING FET AS A RESISTOR

[75] Inventor: Kwok-Fu Chiu, San Jose, Calif.

[73] Assignee: National Semiconductor Corporation, Santa Clara, Calif.

[21] Appl. No.: 632,781

[22] Filed: Apr. 15, 1996

[51] Int. Cl.[6] ..... G05F 1/10; G05F 3/02

[52] U.S. Cl. ..... 327/543; 323/315; 327/530

[58] Field of Search ..... 327/538, 539, 327/540, 541, 542, 543, 544, 545, 546, 537, 437, 378, 427, 432, 434; 323/315

[56] References Cited

U.S. PATENT DOCUMENTS

| | | | |
|---|---|---|---|
| 4,425,551 | 1/1984 | Blackmer et al. | 330/261 |
| 4,591,739 | 5/1986 | Nagano | 323/315 |
| 4,792,750 | 12/1988 | Yan | 323/315 |
| 4,855,684 | 8/1989 | Gerstenhaber et al. | 330/257 |
| 5,132,556 | 7/1992 | Cheng | 327/539 |
| 5,227,714 | 7/1993 | Lou | 323/282 |
| 5,349,308 | 9/1994 | Grasset | 330/296 |
| 5,350,998 | 9/1994 | Marchio et al. | 327/540 |
| 5,525,927 | 6/1996 | Yung et al. | 327/543 |
| 5,548,233 | 8/1996 | Susak | 327/539 |
| 5,596,265 | 1/1997 | Wrathall et al. | 327/539 |
| 5,598,095 | 1/1997 | Schnaitter | 323/315 |
| 5,619,160 | 4/1997 | Sirito-Olivier et al. | 327/530 |

*Primary Examiner*—My-Trang Nu Ton
*Attorney, Agent, or Firm*—Skjerven, Morrill, MacPherson, Franklin, & Friel, LLP; Edward C. Kwok; Glen B. Choi

[57] ABSTRACT

A circuit is provided which generates a reference bias current using a difference in base-emitter voltages of two bipolar transistors imposed across a source terminal and a drain terminal of an MOS transistor. The circuit includes a circuit for compensating shifts in threshold voltage, and thus shifts in the current flowing therein, of the MOS transistor. In one embodiment, the bias circuit is configured to achieve superior efficiency in generating small bias currents. In another embodiment, the bias circuit is configured to operate using minimal voltage supplies. In all embodiments, the reference bias current generated thereby has a positive temperature coefficient and is substantially independent of process variations.

20 Claims, 6 Drawing Sheets

LOW POWER BIAS CIRCUIT USING FET AS A RESISTOR

BACKGROUND

1. Field of the Invention

The present invention relates to the design of electronic circuits, and in particular, relates to the design of CMOS integrated circuits.

2. Discussion of Related Art

A reference bias current can be generating from the difference in the base-emitter voltages of two bipolar transistors of different current densities. One such reference bias current generation circuit is shown in FIG. 1. Referring to FIG. 1, reference bias current generation circuit 100 employs NPN bipolar transistors 102 and 104 to generate a reference bias current $I_{ref}$ which may be used to bias other circuits (not shown). In circuit 100, transistor 104 is designed to have a larger emitter area than does transistor 102 and, as a result, will thus exhibit a smaller current density than will transistor 102. P-channel MOS transistors 106 and 108 source equal currents to the respective collectors of transistors 102 and 104. Thus, when both transistors 102 and 104 are conducting in the linear region, a difference $\Delta V_{BE}$ between their base-emitter voltages results. The emitter terminal of transistor 104 is coupled to a current source 110 by a resistor 112. Thus, the current $I_{ref}$ generated by circuit 100 is determined by the resistance R of resistor 112, where $I_{ref}=\Delta V_{BE}/R$.

Another example of a reference bias current circuit is shown in FIG. 2. Reference bias current generation circuit 200 includes NPN bipolar transistors 202 and 204 which are designed to have different emitter areas and will thus exhibit different current densities. The emitter terminal of transistor 202 is coupled to a current source 206 by a resistor 208 having a resistance R. The emitter terminal of transistor 204 is coupled to current source 210. Current sources 206 and 210 are designed to sink substantially equal currents such that the emitter currents of transistors 202 and 204 are substantially equal.

In circuit 200, the voltage on node 212 (at the emitter terminal of transistor 204) and the voltage on node 214 are forced to be equal by the high gain of an operational amplifier 216, which provides a feedback signal at terminal 218 to control current sources 206 and 210. In equilibrium, the difference in base-emitter voltages of transistors 202 and 204 appears across resistor 208, where $\Delta V_{BE}=V_{be,Q202}-V_{be,Q204}=I_{ref}R$. Thus, the current $I_{ref}$ in each of current sources 206 and 210 is determined by the resistance R of resistor 208, where $I_{ref}=\Delta V_{BE}/R$. A current mirror can be used to generate a current equal to $I_{ref}$ or, in other embodiments, to any fraction or multiple of $I_{ref}$.

In both of the prior art circuits discussed above, a reference bias current arising from the difference in base-emitter voltages of two bipolar transistors is generated by imposing such voltage difference across a resistor. However, if a small reference bias current is preferred, such a resistor would in an integrated circuit implementation require an unreasonably large amount of silicon real estate. For example, in circuit 200 of FIG. 2, if the emitter ratio between transistors 202 and 204 is 10:1, a $\Delta V_{BE}$ of approximately 60 millivolts is achieved. In such an implementation, providing reference currents $I_{ref}$ of 200 nanoamps and 60 nanoamps requires approximately 300 kilo-ohm and 1 Mega-ohm resistances R, respectively. Implementing such large resistances is uneconomical.

Alternatively, the resistor employed in the prior art circuits may be replaced by a field effect transistor (FET) operating in the non-saturation or "triode" region. Such an FET requires a much smaller silicon real estate than does a resistor conducting the same amount of current. However, the use of an FET has at least two disadvantages. First, the threshold voltage $V_T$ of such a transistor is known to vary substantially with variations in the manufacturing process. Consequently, the equivalent resistance attainable by such FET fluctuates with variations in the manufacturing process, thereby leading to large variations in the generated bias current. Secondly, the threshold voltage of such as FET is known to have a negative temperature coefficient. Consequently, the bias current generated by such an FET also has a negative temperature coefficient TC, which is undesirable for most amplifier applications.

FIG. 3 shows a reference bias current generating circuit 300 which overcomes the two disadvantages mentioned above by providing a matched reference transistor that tracks and effectively cancels process variations of the above mentioned FET such that the resistance of the FET is insensitive to process variations. Circuit 300 is described in detail in U.S. Pat. No. 5,469,111 issued to Kwok-Fu Chiu on Nov. 21, 1995 and assigned to National Semiconductor Corp, also the assignee of the present invention, hereby incorporated by reference.

Circuit 300 includes NPN transistors 302 and 304 which are designed to have different emitter areas and will thus exhibit different current densities. The emitter terminal of transistor 302 is coupled to a current source 308 by an NMOS transistor $MN_R$ having a resistance R. The emitter terminal of transistor 304 is coupled to a current source 310. Current sources 308 and 310 are designed to conduct substantially equal currents. Transistor $MN_R$ acts as a resistor in the reference bias current generation circuit 300, in that the difference $\Delta V_{BE}$ in base-emitter voltages of NPN transistors 302 and 304 appears across the drain terminal and the source terminal of transistor $MN_R$. An operational amplifier 312 is employed in a feedback configuration to force the voltages on nodes 313 and 314 to be equal. The feedback signal of op-amp 312 is used to control the bias voltage of current sources 308–311. The current in sources 308 and 310 may be mirrored to an output terminal (not shown) in a conventional manner to provide a bias reference current $I_{ref}$.

A diode-connected NPN transistor 306 biases transistor $MN_R$ at one $V_{be}$ below the supply voltage $V_{cc}$, thereby forcing transistor $MN_R$ to operate in the triode region. A current source 311 sinks current from transistor 306. A diode-connected reference transistor $MN_{ref}$ is connected between $V_{cc}$ and the common base of NPN transistors 302 and 304 to bias the common base of transistors 302 and 304. The current in transistor $MN_{ref}$ is sunk by current source 309. Transistor $MN_{ref}$ is scaled to match the physical dimensions of transistor $MN_R$.

The voltage on node 313 is equal to $V_{cc}$ minus the base-emitter voltage $V_{BE}$ of transistor 306 minus the gate-source voltage $V_{GS}$ of transistor $MN_R$, i.e., $$V_{313}=V_{cc}-V_{BE(Q306)}-V_{GS(MN_R)}$$

The voltage on node 314 is equal to $V_{cc}$ minus the gate-source voltage $V_{GS}$ of transistor $MN_{ref}$ minus the base-emitter voltage $V_{BE}$ of transistor 304, i.e., $$V_{314}=V_{cc}-V_{GS(MN_{ref})}-V_{BE(Q304)}$$

Equating the $V_{BE}$'s of transistors Q304 and Q306 and rearranging terms gives $$V_{GS(MN_R)}=V_{GS(MN_{ref})}$$

In this manner, the $V_{GS}$ of transistor $MN_R$, and thus the threshold $V_T$ and on-resistance R of transistor $MN_R$, is set by reference transistor $MN_{ref}$. Any process variations in transistor $MN_R$ are "mirrored" in and thus canceled by reference transistor $MN_{ref}$, thereby allowing for the resistance R of transistor $MN_R$ to be substantially independent of process variations.

Since the operating points of transistors $MN_R$ and $MN_{ref}$ are in the linear and saturation regions, respectively, the drain current of transistor $MN_R$ may be expressed as:

$$I_{D(MP_R)}=\frac{1}{2}\left(\frac{W}{L}\right)(\beta)(\Delta V_{BE})^2$$

where β is substantially a constant. Noting that $\Delta V_{BE}$ is equal to the drain-source voltage $V_{DS}$ of transistor $MN_R$, the drain current $I_D$ is substantially independent of the threshold voltage $V_T$.

It is known that (i) the constant β has a negative temperature coefficient (TC) approximately proportional to $T^{-3/2}$, where T is the operating temperature, and (ii) $V_{DS}$ varies approximately with the operating temperature T. Thus, the current $I_D$, as a whole, varies approximately with $T^{1/2}$ and, thus, achieves a positive TC.

Although circuit 300 advantageously exhibits a positive temperature coefficient and substantially eliminates the dependence of transistor $MN_R$'s resistance R upon process variations, circuit 300 consumes an undesirably large amount of current when generating small bias reference currents. For example, when configured to provide a reference bias current of 0.2 micro-amps, current sources 308–311 sink approximately 0.2, 0.4, 0.2, and 0.13 micro-amps, respectively, plus the current consumed by op-amp 312 (approximately 0.5 micro-amps). Accordingly, circuit 300 consumes almost 1.5 micro-amps of current to provide a reference bias current of just 0.2 micro-amps. Thus, it is desired to build a reference bias current generating circuit which not only is relatively insensitive to process variations and has a positive temperature coefficient but which also consumes a minimal amount of current.

Further, note that the minimum supply voltage required across circuit 300 is approximately 2.4 volts. That is, the base-emitter drop across transistor Q306 plus the gate-source voltage across transistor $MN_R$ plus the input common voltage required by op-amp 312, which is equal to the sum of a $V_{BE}$ and a $V_{Dsat}$, equals approximately 2.4 volts. Therefore, circuit 300 is not capable of operating with voltage supplies of less than 2.4 volts. Thus, it would also be desirable to form a bias circuit which may be used with smaller supply voltages.

SUMMARY OF THE INVENTION

In accordance with the present invention, a circuit is provided which generates a reference bias current using a difference in base-emitter voltages of two bipolar transistors imposed across a source terminal and a drain terminal of an MOS transistor. The circuit includes a circuit for compensating shifts in threshold voltage, and thus shifts in the current flowing therein, of the MOS transistor. In one embodiment, the bias circuit is configured to achieve superior efficiency in generating small bias currents. In another embodiment, the bias circuit is configured to operate using minimal voltage supplies. In all embodiments, the reference bias current generated thereby has a positive temperature coefficient and is substantially independent of process variations.

The present invention is better understood in view of the detailed description below and the accompanying drawings.

DETAILED DESCRIPTION

The present invention provides a reference bias current generation circuit using a transistor, rather than a resistor. In addition, the reference bias current generation includes a compensating transistor which operates in a manner such that the reference bias current generated has a positive temperature coefficient (TC), is insensitive to variations in the threshold voltage (V*T*) of MOS transistors resulting from variations in the manufacturing process, and consumes minimal current.

Figure 4:
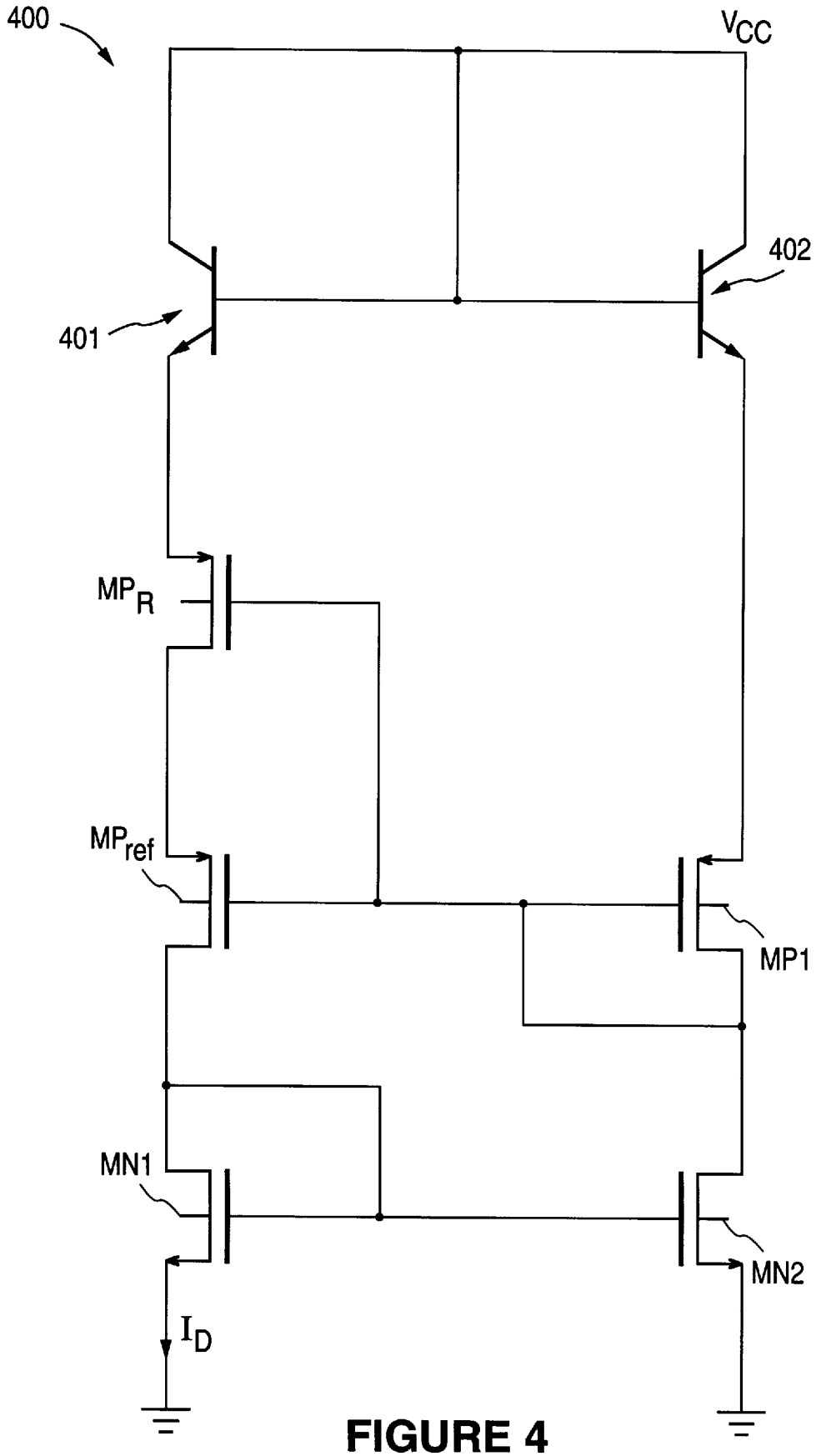
FIG. 4 is a schematic diagram of a bias circuit 400 in accordance with one embodiment of the present invention.

One embodiment in accordance with the present invention is illustrated by FIG. 4. Circuit 400 includes NPN transistors 401 and 402 having their respective collectors and bases coupled to a supply voltage $V_{cc}$. The collector currents in transistors 401 and 402 are thus equal. Transistors 401 and 402 are designed to have different emitter areas and thus will exhibit different current densities. In the preferred embodiment, the ratio of emitter areas of transistors 401 and 402 is 9:1. P-channel MOS transistors $M_R$ and $MP_{ref}$ and N-channel MOS transistor MN1 are connected in series between the emitter of transistor 401 and ground, while P-channel MOS transistor MP1 and N-channel MOS transistor MN2 are connected in series between the emitter of transistor 402 and ground. Transistors MP1 and $MP_{ref}$ are scaled to match each other, and transistors MN1 and MN2, which sink current from transistors 401 and 402, respectively, are scaled to match each other. Thus, the current flowing in the right and left halves of circuit 400 should be substantially equal to one another.

The difference between the base-emitter voltages of transistors 401 and 402, $\Delta V_{BE}$, is given by the following loop equation:

$$\Delta V_{BE}=V_{BE(Q402)}-V_{BE(Q401)}=V_{GS(MP_{ref})}-V_{GS(MP1)}+V_{DS(MP_R)}$$

Since transistors MP1 and $MP_{ref}$ are matched to have similar physical dimensions, the gate-source voltages of transistors MP1 and $MP_{ref}$ equal one another, irrespective of any process variations. Thus, the above equation can be reduced to:

$$\Delta V_{BE}=V_{DS(MP_R)}$$

In other words, circuit 400 realizes an IR drop equal to $\Delta V_{BE}$ across the drain and source terminals of transistor $MP_R$.

Since the $V_{GS}$ of transistor $MP_R$ is equal to the sum of the $V_{GS}$ of transistor $MP_{ref}$ and the $V_{DS}$ of transistor $MP_R$, transistor $MP_R$ is thus forced to operate in the triode region. Transistors MN1 and MN2, which are biased to operate in the saturation region, act as a current mirror. From the loop equation $$\Delta V_{BE}=V_{DS(MP_R)}=V_{GS(MP_R)}V_{GS(MP_{ref})}$$

it can be seen that the threshold voltage $V_T$ of transistor $MP_{ref}$ tracks the threshold voltage $V_T$ of transistor $MP_R$. Variations in the $V_T$ of transistor $MP_R$ resulting from variations in the manufacturing process are effectively matched, and therefore canceled, by similar variations in the $V_T$ of transistor $MP_{ref}$. Accordingly, the drain current $I_D$ of transistor $MP_R$, which may be mirrored by conventional means to provide a reference bias current $I_{ref}$ to an associated circuit (not shown), may be expressed as:

$$I_D=\frac{1}{2}(\beta)\left(\frac{W}{L}\right)_{MP_{ref}}(\Delta V_{BE})^2(r+\sqrt{r^2+r}),$$

where $$r=\frac{(W/L)_{MP_R}}{(W/L)_{MP_{ref}}}.$$

Thus, the drain current $I_D$ is substantially independent of the threshold voltage $V_T$. Further, since $I_D$ is proportional to the square of $\Delta V_{BE}$, the drain current $I_D$ advantageously has a positive temperature coefficient TC.

Figure 1:
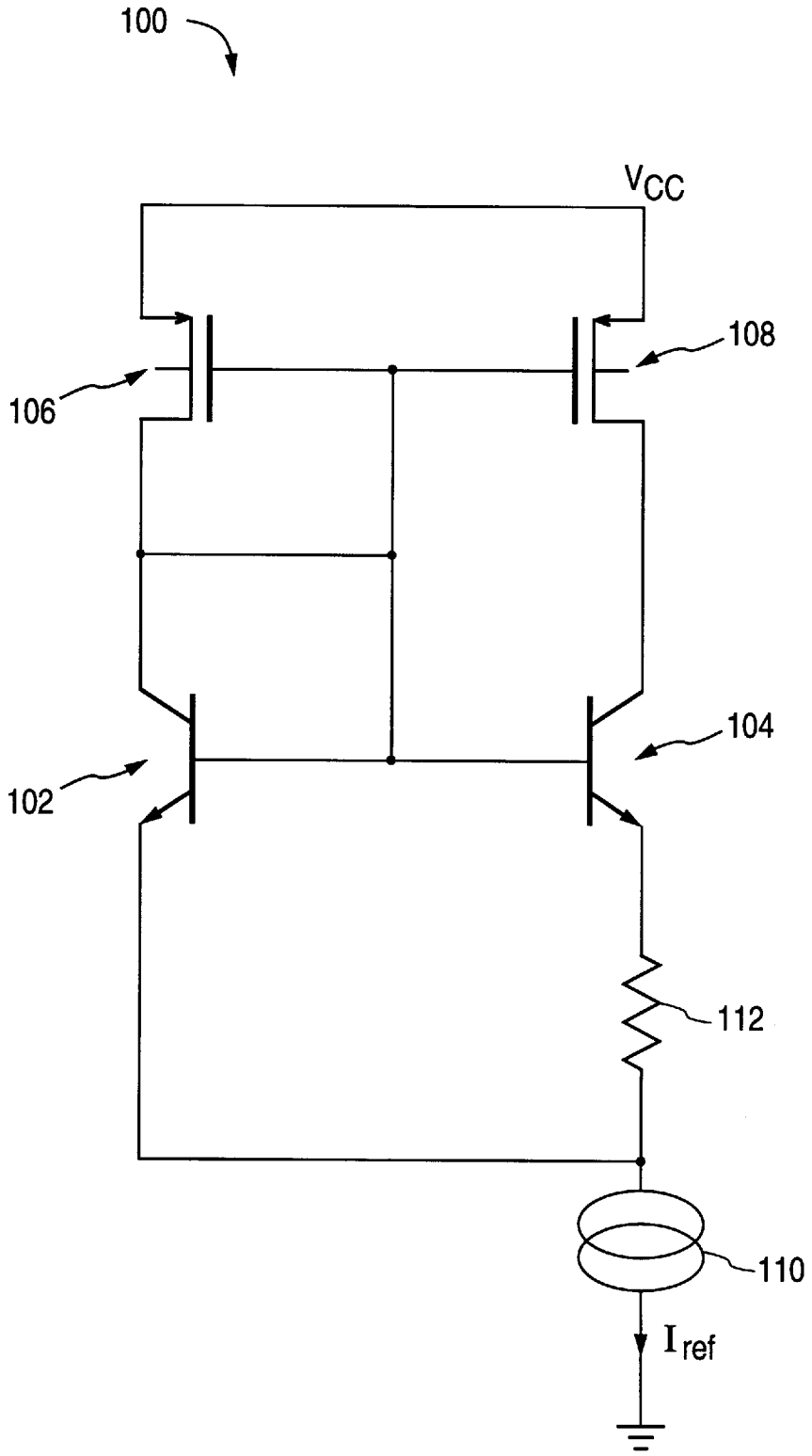
FIGURE 1 (PRIOR ART)
FIGS. 1–3 are conventional reference bias current generation circuits.
Figure 2:
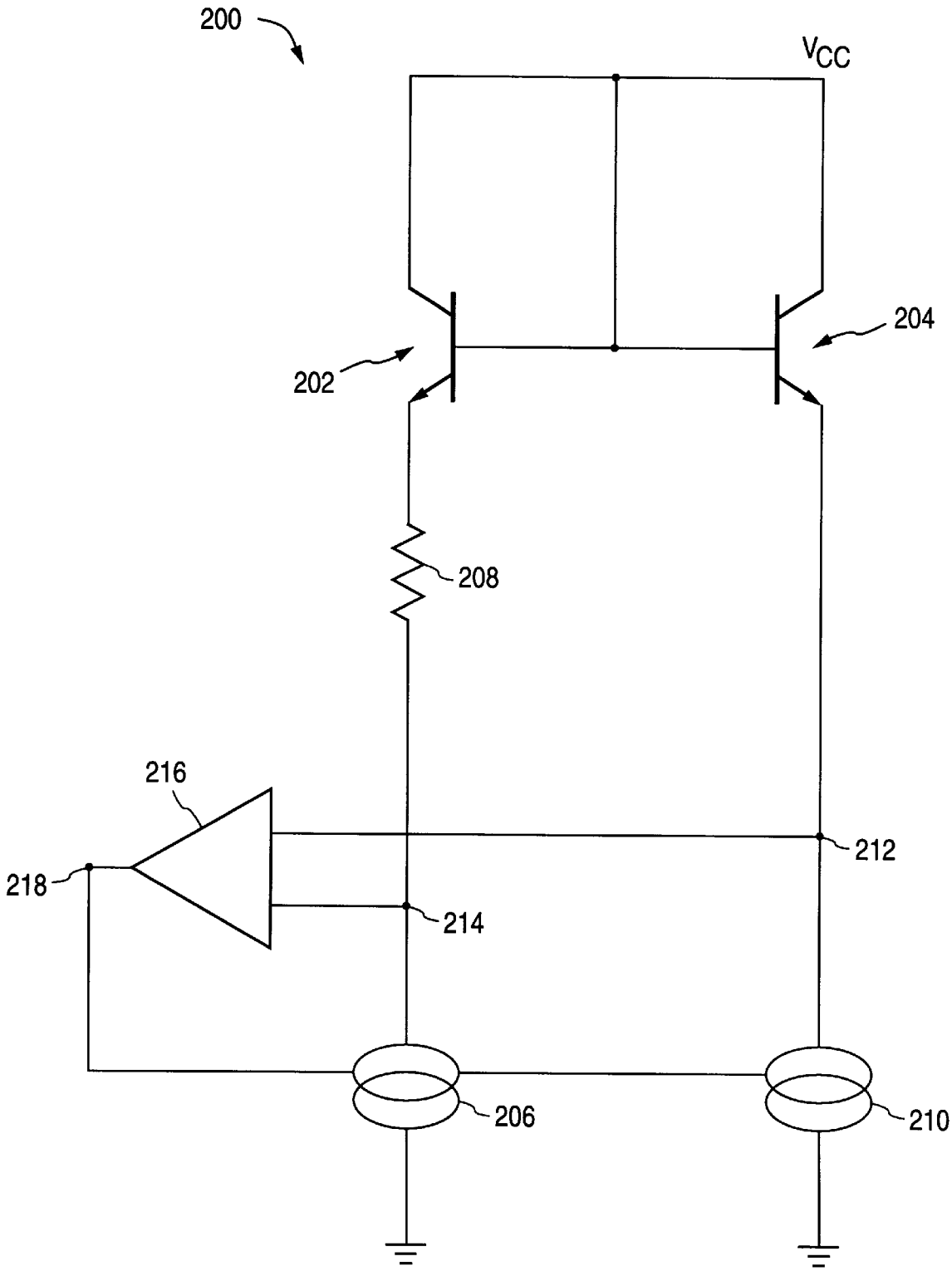
FIGURE 2 (PRIOR ART)
Figure 3:
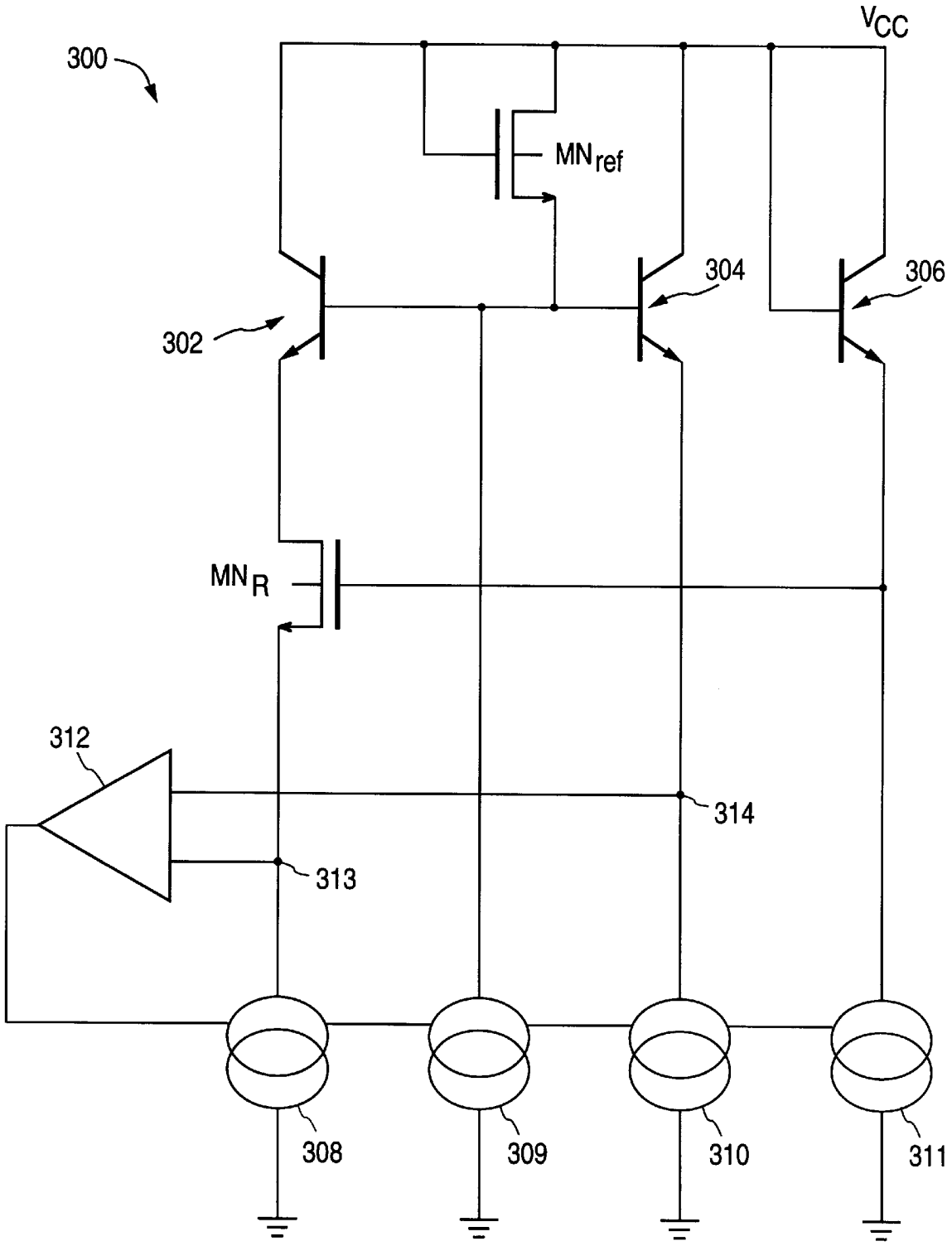
FIGURE 3 (PRIOR ART)

Circuit 400 consumes much less current, and therefore less power, than does conventional circuit 300 (FIG. 3). For instance, when providing a 0.2 micro-amp reference current $I_{ref}$, circuit 400 requires a 0.2 micro-amp current in each of sink transistors MN1 and MN2. Thus, circuit 400 requires only 0.4 micro-amps of internal current to generate a reference current $I_{ref}$ of 0.2 micro-amps. In contrast, conventional circuit 300 requires, as discussed above, a total internal current of almost 1.5 micro-amps to generate the same 0.2 micro-amp reference current $I_{ref}$.

Figure 5:
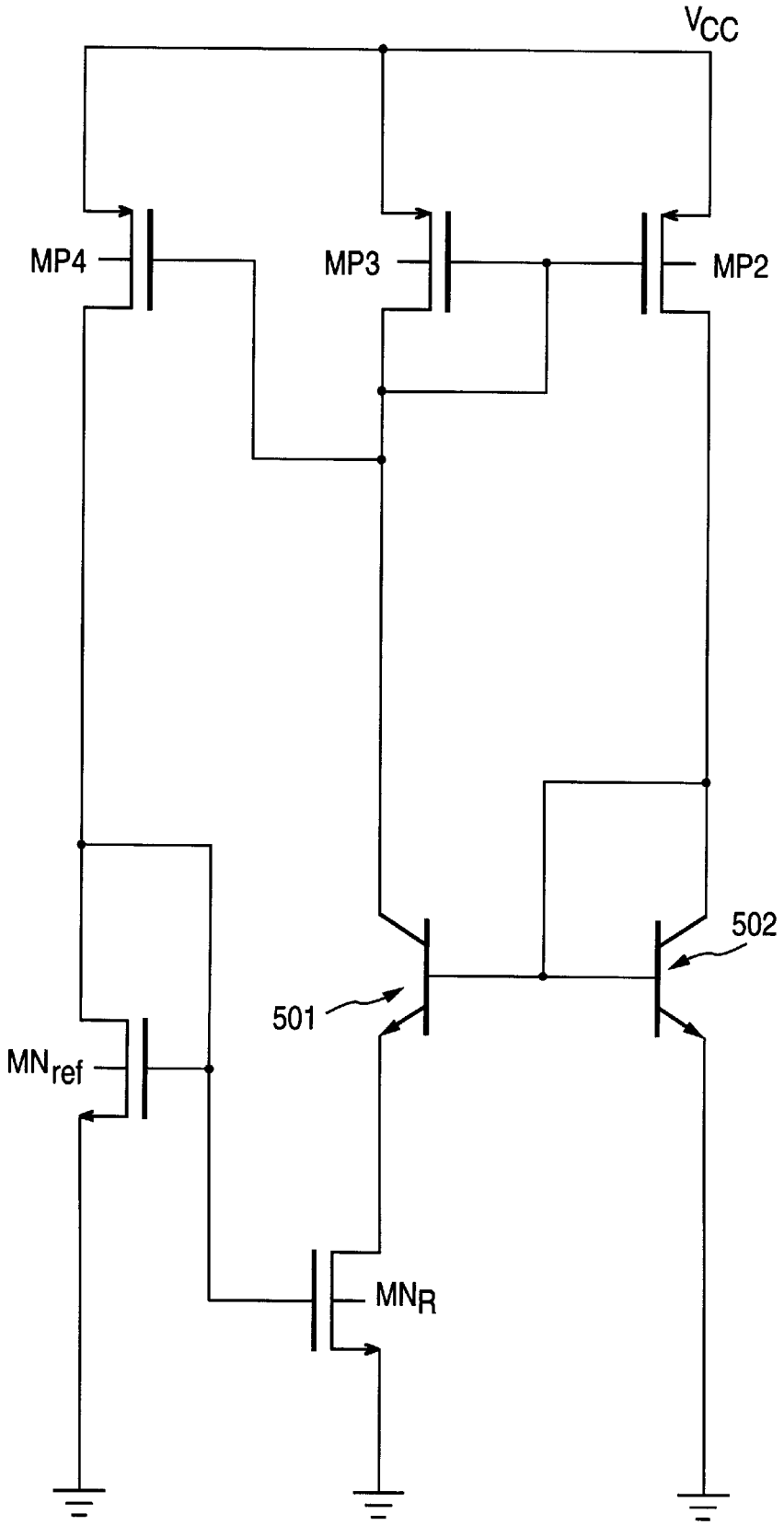
FIG. 5 is a schematic diagram of a bias circuit 500 in accordance with another embodiment of the present invention.

Another embodiment in accordance with the present invention is illustrated in FIG. 5. Bias circuit 500 includes PMOS transistors MP2, MP3, and MP4, NMOS transistors $MN_R$ and $MN_{ref}$, and NPN transistors 501 and 502. PMOS transistors MP2–MP4 are scaled to be of similar physical dimensions so as to provide equal currents to the collectors of NPN transistors 501 and 502 and to the drain of NMOS transistor $MN_{ref}$, respectively.

Transistor 501 is designed to have a larger emitter area than does transistor 502 and therefore exhibits a smaller current density than does transistor 502. Thus, when both transistors 501 and 502 are conducting in the linear region, a difference $\Delta V_{BE}$ between their base-emitter voltages results. In this embodiment, the ratio of the emitter areas of transistors 501 and 502 is approximately 10:1 and $\Delta V_{BE}$ is equal to approximately 60 mV. This $\Delta V_{BE}$ appears as an IR voltage drop across transistor $MN_R$, i.e., the drain-source voltage $V_{DS}$ of transistor $MN_R$ equals $\Delta V_{BE}$. Note that transistors 501 and 502 force transistor $MN_R$ to operate in the triode region.

Since the respective gates of diode-connected transistor $MN_{ref}$ and transistor $MN_R$ are tied together and the respective sources of transistors $MN_{ref}$ and $MN_R$ are tied together, the gate-source voltage $V_{GS}$ of transistor $MN_{ref}$ is equal to the gate-source voltage $V_{GS}$ of transistor $MN_R$. In this manner, the threshold voltage $V_T$ of transistor $MN_R$ is set by reference transistor $MN_{ref}$. Any process variations in transistor $MN_R$ are mirrored in and thus canceled by reference transistor $MN_{ref}$, thereby allowing the resistance of, and thus the IR voltage drop across, transistor $MN_R$ to be substantially independent of process variations as long as the drain current of reference transistor $MN_{ref}$ substantially equals that of transistor $MN_R$. Thus, the drain current $I_D$ of transistor $MN_R$ may be expressed by the following equation:

$$I_D=\frac{1}{2}\left(\frac{W}{L}\right)_{MN_{ref}}(\beta)(\Delta V_{BE})^2(r+\sqrt{r^2-r}),$$

where $$r=\frac{(W/L)_{MN_{ref}}}{(W/L)_{MN_R}}.$$

Thus, since $I_D$ is proportional to the square of $\Delta V_{BE}$, as can be seen from the above equations, the drain current $I_D$ of transistor $MN_R$ advantageously has a positive temperature coefficient TC.

Bias circuit 500 is capable of generating a reference current $I_{ref}$ mirrored from the drain of transistor $MN_{ref}$ in a conventional manner. To generate a reference current $I_{ref}$ of, for example, 0.2 micro-amps, circuit 500 requires a total of 0.6 micro-amps: 0.2 micro-amps in the drain of transistor $MN_{ref}$ and 0.2 micro-amps in each of the collectors of transistors 501 and 502. As a result, circuit 500 is less efficient than circuit 400 (FIG. 4).

However, circuit 500 is advantageously able to operate using lower supply voltages than is circuit 400 or prior art circuits 100–300. Referring to FIG. 5, the voltage drop between the rails, e.g., between $V_{cc}$ and ground, may be expressed as $$V_{CC}=V_{DS(MN_R)}+V_{CE,sat(Q501)}+V_{GS(MP3)}$$

and, thus, allows for a minimum supply voltage of less than 1.2 volts. Thus, circuit 500 is capable of efficiently providing small bias currents while operating with a 1.2 volt supply. In contrast, circuit 400 requires an operating supply of approximately 1.8 volts, as can be seen from the following equation:

$$V_{CC}=V_{BE(Q401)}+V_{GS(MP_R)}+V_{DS,sat(MN2)}.$$

Figure 6:
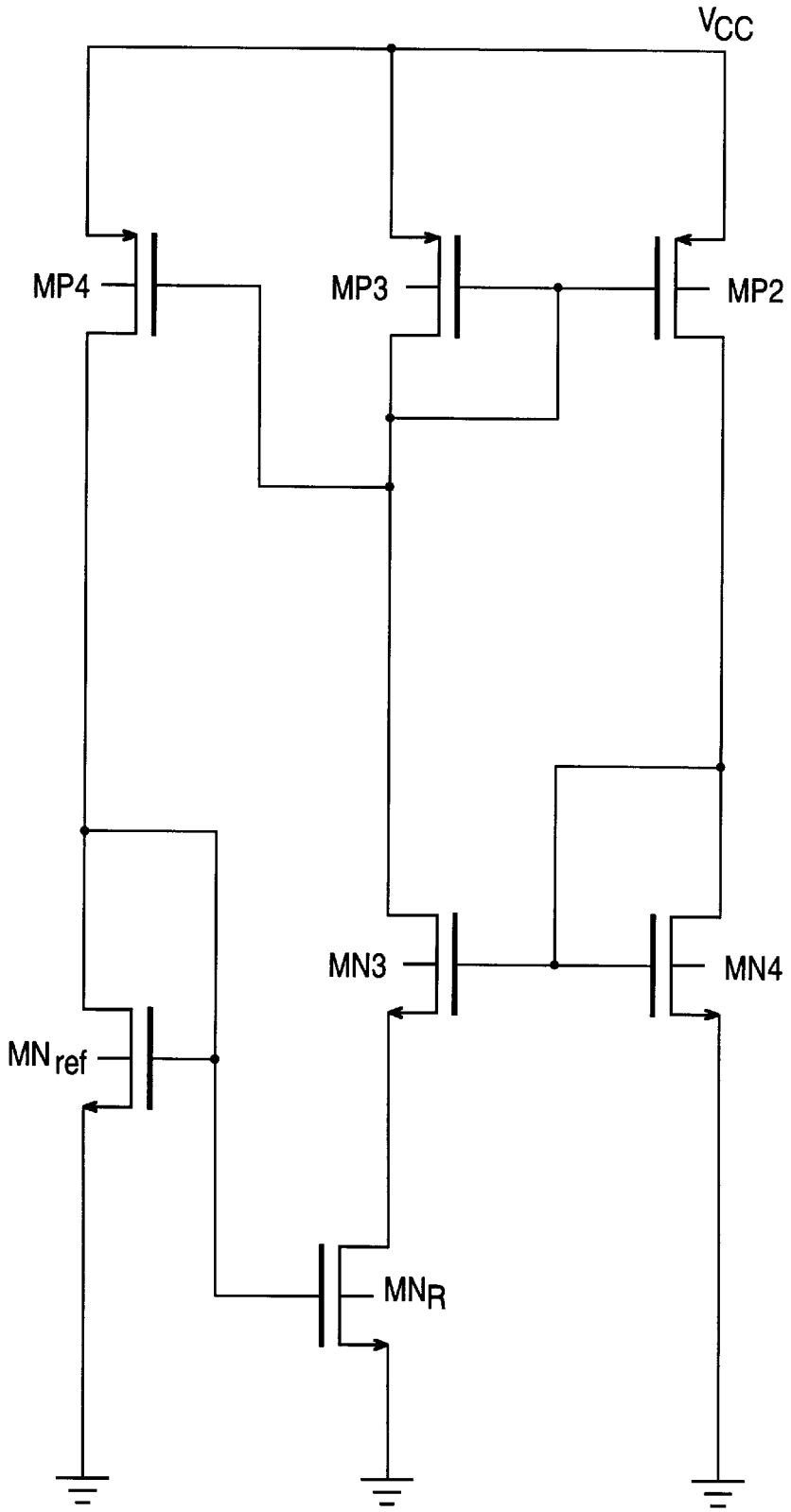
FIG. 6 is a schematic circuit of a bias circuit 600 in accordance with yet another embodiment of the present invention.

In other embodiments, the bipolar transistors employed in the above described circuit implementations 400 and 500 of the present invention may be replaced with MOS transistors while still realizing the advantages of the present invention. For example, in one embodiment shown in FIG. 6 as circuit 600, NPN transistors 501 and 502 have been replaced with NMOS transistors MN3 and MN4, respectively. Further, the polarities of the above described transistors may be reversed without departing from the scope of the present invention.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

We claim:

1. A bias circuit for providing a reference bias current, said bias circuit generates comprising:

a first bipolar transistor and a second bipolar transistor having a first base-emitter voltage and a second base-emitter voltage, respectively;

a first MOS transistor, said bias circuit imposing the first and second base-emitter voltages across a source terminal and a drain terminal of said first MOS transistor; and a circuit for compensating variations in said bias current arising from a shift in a threshold voltage of said first MOS transistor by offsetting said shift in said threshold voltage with a voltage approximately the same as said shift in said threshold voltage.

2. A bias circuit for providing a reference bias current, said bias circuit generates comprising:

a first bipolar transistor and a second bipolar transistor having a first base-emitter voltage and a second base-emitter voltage, respectively:

a first MOS transistor, said bias circuit imposing the first and second base-emitter voltages across a source terminal and a drain terminal of said first MOS transistor;

a circuit for compensating variations in said bias current arising from a shift in a threshold voltage of said first MOS transistor, wherein said circuit for compensating comprises:

a second MOS transistor having a source terminal coupled to said drain terminal of said first MOS transistor, a gate terminal coupled to a gate terminal of said first MOS transistor, and a drain terminal;

a third MOS transistor having a source terminal coupled to an emitter terminal of said second bipolar transistor, and a gate terminal and a drain terminal coupled to said gate terminal of said second MOS transistor; and a current mirror having first and second terminals for providing substantially equal current to said second and third MOS transistors, respectively.

3. The circuit of claim 2 wherein said current mirror comprises:

a fourth MOS transistor having a source terminal coupled to a voltage supply, a drain terminal coupled to said drain terminal of said second MOS transistor, and a gate terminal coupled to said drain terminal of said fourth MOS transistor; and a fifth MOS transistor having a source terminal coupled to said voltage supply, a drain terminal coupled to said drain terminal of said third MOS transistor, and a gate terminal coupled to said gate terminal of said fourth MOS transistor.

4. A bias circuit for providing a reference bias current, said bias circuit generates comprising:

a first bipolar transistor and a second bipolar transistor having a first base-emitter voltage and a second base-emitter voltage, respectively;

a first MOS transistor, said bias circuit imposing the first and second base-emitter voltages across a source terminal and a drain terminal of said first MOS transistor;

a circuit for compensating variations in said bias current arising from a shift in a threshold voltage of said first MOS transistor, wherein said circuit for compensating comprises:

a second MOS transistor having a source terminal coupled to a voltage supply, and a gate terminal and a drain terminal coupled to a gate terminal of said first MOS transistor; and a current mirror having a first, second, and third terminals for providing current to a collector terminal of said first bipolar transistor, to a collector terminal of said second bipolar transistor, and to said drain terminal of said second MOS transistor.

5. The circuit of claim 4 wherein said current mirror comprises:

a third MOS transistor having a source terminal coupled to a second voltage supply, and having a gate terminal and a drain terminal coupled to said collector terminal of said first bipolar transistor;

a fourth MOS transistor having a source terminal coupled to said second supply voltage, a gate terminal coupled to said gate terminal of said third MOS transistor, and a drain terminal coupled to said collector terminal of said second bipolar transistor; and a fifth MOS transistor having a source terminal coupled to said second voltage supply, a gate terminal coupled to said gate terminal of said third MOS transistor, and a drain terminal coupled to said drain terminal and gate terminal of said second MOS transistor.

6. A reference bias current generation circuit comprising:

a first transistor having a first terminal coupled to a first supply voltage, a second terminal, and a control terminal;

a second transistor having a first terminal coupled to said first supply voltage, a control terminal coupled to said control terminal of said first transistor, and a second terminal;

a third transistor having a first terminal coupled to said second terminal of said first transistor, a second terminal, and a control terminal; and a circuit, coupled to said control terminal and said second terminal of said third transistor and said second terminal of said second transistor, for compensating in a current of said third transistor variations due to a shift in a threshold voltage of said third transistor by offsetting said shift in said threshold voltage with a voltage approximately the same as said shift in said threshold voltage.

7. A reference bias current generation circuit comprising:

a first transistor having a first terminal coupled to a first supply voltage, a second terminal, and a control terminal;

a second transistor having a first terminal coupled to said first supply voltage, a control terminal coupled to said control terminal of said first transistor, and a second terminal;

a third transistor having a first terminal coupled to said second terminal of said first transistor, a second terminal, and a control terminal; and a circuit, coupled to said control terminal and said second terminal of said third transistor and said second terminal of said second transistor, for compensating in a current of said third transistor variations due to a shift in a threshold voltage of said third transistor, wherein said circuit for compensating comprises:

a fourth transistor having a first terminal coupled to said second terminal of said third transistor, a second terminal, and a control terminal;

a fifth transistor having a first terminal coupled to said second terminal of said second transistor, and a second terminal and a control terminal coupled to said control terminal of said fourth transistor; and a current mirror having first and second terminals for providing substantially equal current to said fourth and fifth transistors, respectively.

8. The circuit of claim 7 wherein said current mirror comprises:

a sixth transistor having a source terminal coupled to a second voltage supply, and a gate terminal and a drain terminal coupled to said second terminal of said fourth transistor; and a seventh transistor having a source terminal coupled to said second voltage supply, a drain terminal coupled to said second terminal of said fifth transistor, and a gate terminal coupled to said gate terminal and said drain terminal of said sixth transistor.

9. The circuit of claim 7 wherein said first and second transistors comprise bipolar transistors.

10. The circuit of claim 7 wherein said first and second transistors comprise MOS transistors.

11. A reference bias current generation circuit comprising:

a first transistor having a first terminal coupled to a first current source, a second terminal, and a control terminal;

a second transistor having a first terminal coupled to a second current source, a control terminal coupled to said control terminal of said first transistor, and a second terminal coupled to a voltage supply;

a third transistor having a first terminal coupled to said second terminal of said first transistor, a second terminal coupled to said voltage supply, and a control terminal; and a circuit, coupled to control said control terminal of said third transistor, for compensating in the current of said third transistor variations due to a shift in a threshold voltage of said third transistor.

12. The circuit of claim 11, wherein said circuit for compensating comprises a fourth transistor having a first terminal coupled to said control terminal of said third transistor, and to a third current source, and to said control terminal of said fourth transistor, and having a second terminal.

13. The circuit of claim 12 wherein said first, second, and third current sources provide equal currents.

14. The circuit of claim 12 wherein said first and second transistors comprise bipolar transistors.

15. The circuit of claim 12 wherein said first and second transistors comprise MOS transistors.

16. A reference bias current generation circuit comprising:

a first transistor having a first terminal, a second terminal, and a control terminal;

a second transistor having a first terminal, a second terminal coupled to a first supply voltage, and a control terminal coupled to said control terminal of said first transistor and said first terminal of said second transistor;

a third transistor having a first terminal coupled to said second terminal of said first transistor, a second terminal coupled to said first supply voltage, and a control terminal; and a circuit, coupled to said control terminal of said third transistor, said first terminal of said first transistor, and said first terminal of said second transistor, for compensating in a current of said third transistor variations due to a shift in a threshold voltage of said third transistor by offsetting said shift in said threshold voltage with a voltage approximately the same as said shift in said threshold voltage.

17. The circuit of claim 16, wherein said circuit for compensating comprises:

a fourth transistor having a first terminal, a control terminal, said control terminal coupled to said first terminal of said fourth transistor and said control terminal of said third transistor, and a second terminal coupled to said first supply voltage;

a fifth transistor having a first terminal coupled to a second supply voltage, a second terminal coupled to said first terminal of said fourth transistor, and a control terminal coupled to said first terminal of said first transistor; and a current mirror having first and second terminals for providing substantially equal current to said first and second transistors, respectively.

18. The circuit of claim 17 wherein said current mirror comprises:

a sixth transistor having a source terminal coupled to said second voltage supply, and a gate terminal and a drain terminal coupled to said first terminal of said first transistor; and a seventh transistor having a source terminal coupled to said second voltage supply, a drain terminal coupled to said first terminal of said second transistor, and a gate terminal coupled to said gate terminal and said drain terminal of said sixth transistor.

19. The circuit of claim 17 wherein said first and second transistors comprise bipolar transistors.

20. The circuit of claim 17 wherein said first and second transistors comprise MOS transistors.

* * * * *